United States Patent [19]

Böhringer et al.

[11] Patent Number: 4,649,883

[45] Date of Patent: Mar. 17, 1987

[54] FUEL INJECTION PUMP FOR INTERNAL COMBUSTION ENGINES

[75] Inventors: Wilfried Böhringer, Flein; Franz Eheim, Stuttgart; Gerald Höfer, Weissach-Flacht; Karl Konrath, Ludwigsburg; Helmut Laufer, Stuttgart, all of Fed. Rep. of Germany

[73] Assignee: Robert Bosch GmbH, Stuttgart, Fed. Rep. of Germany

[21] Appl. No.: 610,724

[22] Filed: May 16, 1984

[30] Foreign Application Priority Data

Jul. 27, 1983 [DE] Fed. Rep. of Germany ..... 3326973

[51] Int. Cl.[4] ..... F02M 39/00

[52] U.S. Cl. ..... 123/449; 123/503; 123/506

[58] Field of Search ..... 123/449, 506, 503; 417/494, 499

[56] References Cited

U.S. PATENT DOCUMENTS

| | | | |
|---|---|---|---|
| 3,848,576 | 11/1974 | Höfer | 123/449 |
| 4,111,173 | 9/1978 | Skinner | 123/506 |
| 4,407,249 | 10/1983 | Eheim | 123/449 |

FOREIGN PATENT DOCUMENTS

| | | | |
|---|---|---|---|
| 2503324 | 7/1976 | Fed. Rep. of Germany | 123/449 |
| 867578 | 11/1941 | France | 123/503 |
| 0102423 | 8/1979 | Japan | 123/449 |
| 2102508 | 2/1983 | United Kingdom | 123/449 |

*Primary Examiner*—Carl Stuart Miller
*Attorney, Agent, or Firm*—Edwin E. Greigg

[57] ABSTRACT

A fuel injection pump which has a shutoff device for the fuel supply to the pump work chamber, comprising a magnetic valve, which controls an intake bore to the work chamber of the fuel injection pump. The fuel injection pump further has a relief conduit, which is connected by an annular slide on the pump piston with the suction chamber in order to terminate the effective supply stroke of the pump piston. In order to assure reliable shutoff of the fuel supply to the pump work chamber, a check valve is further disposed in the connection between the pump work chamber and the suction chamber, which check valve is closed, during the intake stroke of the pump piston, with the collaboration of the pressure drop from the suction chamber to the pump work chamber.

7 Claims, 10 Drawing Figures

FUEL INJECTION PUMP FOR INTERNAL COMBUSTION ENGINES

BACKGROUND OF THE INVENTION

The invention is based on a fuel injection pump for internal combustion engines. In a fuel injection pump of this kind, known from German Offenlegungsschrift 25 03 355, upon the closure of an intake bore with the aid of a magnetic valve, fuel can flow out of a suction chamber into a work chamber via a diversion cross section at a quantity adjusting device and via a relief conduit in the pump piston, so that despite a closure of the intake bore, fuel can still proceed to injection. If the pressure in the interior of the suction chamber is sufficiently high, and if the diversion cross sections for the rapid relief of the pump work chamber are sufficiently large, then the quantity of fuel aspirated via this route suffices to prevent the internal combustion engine operated with this fuel injection pump from shutting down. As a result, the intended purpose of shutting down the engine by the magnetic valve in the intake bore fails to be attained.

OBJECT AND SUMMARY OF THE INVENTION

The fuel injection pump according to the invention has the advantage over the above-described fuel injection pump that shutoff of the engine is assuredly effected via the valve in the intake bore.

The embodiment set forth has the advantage that the connection to the pump work chamber is broken directly with a check valve, and the check valve itself is protected from any harmful external mechanical effects that could affect its ability to function. Furthermore only a very small volume remains between the check valve and the work chamber, which after a periodic relief during the intake stroke phase of the pump piston, perhaps due to suction chamber pressure, is refilled by means of a relief device of the injection conduits. The fuel quantity possibly reaching the work chamber as a result of this relieving operation is so slight that operation of the engine cannot be maintained, and the engine thus shuts down very rapidly, along with the fuel injection pump.

With another embodiment it is possible to attain an advantageous realization of a check valve, for the purpose according to the invention, wherein the check valve is accommodated in a part that is easily accessible and simple to operate. An advantageous feature is that the pump piston is neither stressed nor weakened by an additional device provided for receiving the check valve.

Other provisions result in a particularly simple, weight-saving and easily realized embodiment of the check valve. As a result, the leaf spring, which is preferably thin and lightweight for the sake of quick reaction, is protected from mechanical destruction during the diversion operation when the pump is operating normally.

Another embodiment makes it possible to easily replace any check valves that may have become damaged.

A check valve disposed on the pump piston is advantageously embodied where, from the end face of the pump piston remote from the pump work chamber, the conduit part having the greater diameter is easily furnished. An extremely simple realization of a check valve in the closing member can be realized without the interposition of resilient restoring forces and is held in place by an inserted bolt. In an advantageous manner, however, for reliable and still-faster closing of the relief conduit, another embodiment can be provided, while with the use of a ball, the reliable support of the ball with a sufficiently large flowthrough cross section between the ball and the conduit part having the enlarged diameter is assured. The bolt which serves to limit the path of the valve closing member is advantageously pressed in from the end face of the pump piston in order to generate a sealed closure of the conduit.

A particularly advantageous further realization of the invention is represented herein. It is advantageous that no additionally movable valve closing member is required. The quantity adjusting device itself is provided with an additional valve function by means of the embodiment of its control edge. This solution offers the advantage of high operational reliability and production at a favorable cost. Additional movable valve closing members, which can cause malfunctioning, are eliminated.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
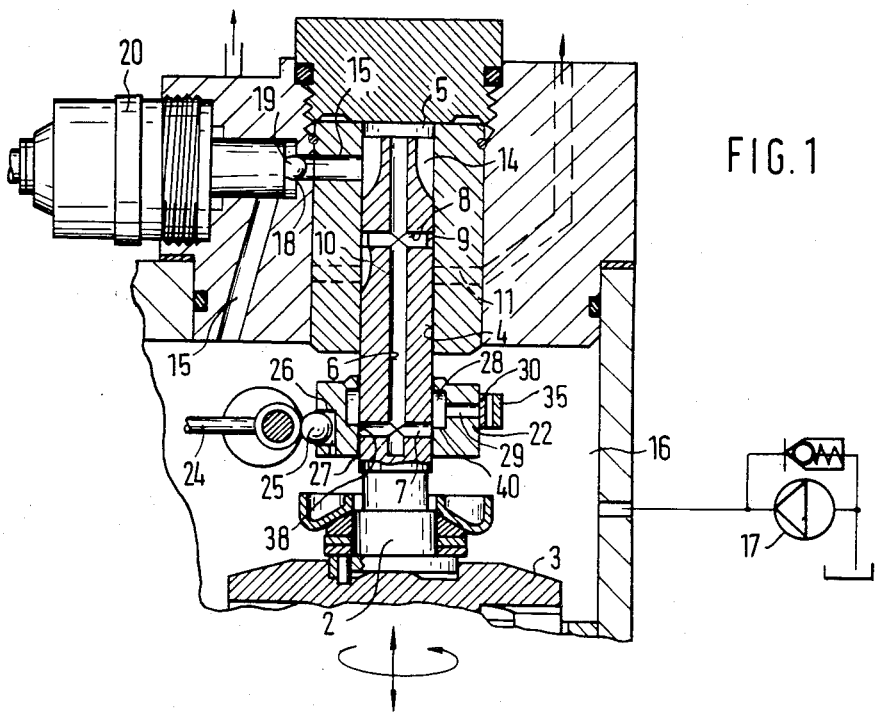
FIG. 1 shows a first exemplary embodiment of the invention, taking as an example a distributor injection pump having a shutoff magnet for shutting off the engine and a check valve on the quantity adjusting device.

In the drawing, FIG. 1 schematically shows a partial section taken through a distributor injection pump, in which in a known manner a pump piston 2 can be set into simultaneously reciprocating and rotating motion by a drive mechanism not further shown, via a cam disk 3. The pump piston is displaceable in a cylinder 4 closed at the front end, which in combination with one end face of the pump piston encloses a pump work chamber 5. The pump piston further has an axial relief conduit 6 beginning at its end face toward the pump work chamber. The relief conduit 6 leads to a first transverse conduit 7 in the pump piston and communicates with an additional transverse conduit 8, which discharges into an annular groove 9 on the pump piston. A longitudinal distributor groove 10 leads away from the annular groove 9 and cooperates with injection lines 11 extending in the pump housing. The injection lines are distributed over the circumference of the cylinder 4 in accordance with the number of cylinders of the associated internal combustion engine that are to be supplied with fuel. The injection lines lead, preferably via a check valve, to the injection nozzles, not shown further.

Longitudinal grooves 14 lead away from the end face of the pump piston 2 on the side of the pump work chamber, and by way of these longitudinal grooves 14, upon each intake stroke of the pump piston, the pump work chamber is connected with an intake bore 15 which leads from the pump suction chamber 16 of the fuel injection pump to the cylinder 4. The suction chamber of the fuel injection pump is supplied in a manner known per se with fuel under pressure via a fuel feed pump 17.

A valve seat 18 is provided in the intake bore 15, and in order to close this intake bore 15 a valve closing member 19 of a magnetic valve 20 can be brought into position against this valve seat 18.

Figure 2:
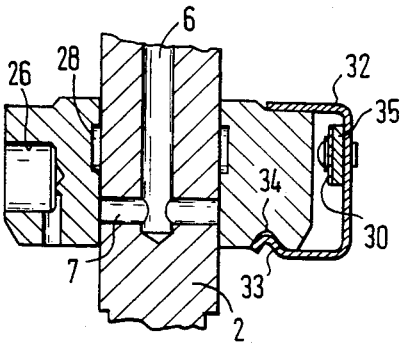
FIG. 2 is a sectional view through the quantity adjusting device showing the disposition of the check valve.
Figure 3:
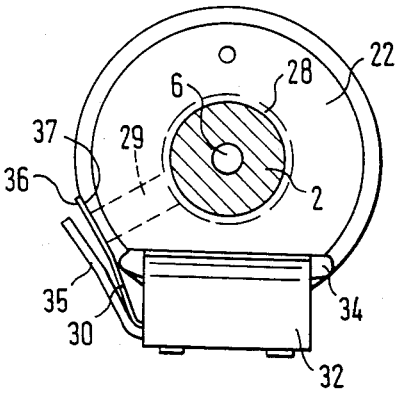
FIG. 3 is an end view of the quantity adjusing device according to the embodiment of FIGS. 1 and 2.

Also provided in the vicinity of the suction chamber 16 on the pump piston is a quantity adjusting device 22, which in the realization as an annular slide is displaceable with a sliding fit on the pump piston. To displace the annular slide, a governor lever 24 is provided, which with a head 25 engages a recess 26 of the annular slide 22. The annular slide has an inner annular groove 28, which begins at its inner bore 27 and together with the pump piston forms a diversion chamber. From the inner annular groove 28, a radial bore 29 leads to the suction chamber 16, the outlet opening of which at the annular slide is closable by means of a leaf spring 30. The leaf spring 30 is secured on the annular slide 22 and serves as the closing member of a check valve, which tends to close the radial bore 29. The leaf spring is secured on a carrier embodied as a holder bracket 32, as may be seen in FIGS. 2 and 3. The U-shaped holder bracket 32 rests with one shank on the upper end face of the annular slide 22 and with one end 33, deformed in an annular bulge, of the other shank engages a correspondingly provided groove 34 on the lower end face of the annular slide 22. Thus the carrier can be removed from the annular slide easily, by bending one of the shanks. The leaf spring 30 is then riveted, together with a support bracket 35, to the carrier and protrudes out from the carrier at the side, such that an end 36 of the leaf spring that extends in a flat course at the end rests flatly on a flattened zone 37 on the outer circumference of the annular slide 22. The radial bore 29 discharges in the vicinity of this flattened zone 37.

The annular slide 22 is displaced via the governor lever 24 by means of a governor, not further shown, in such a manner that during the pump supply stroke of the pump piston 2, the relief opening 38 at the outlet of the transverse conduit 7 at the pump piston is opened up earlier or later by means of the lower limiting edge 40 of the annular groove 28.

The apparatus described functions as follows:

During the downward, or intake, stroke of the pump piston, one of the longitudinal grooves 14 is brought into communication with the intake bore 15. During operation of the fuel injection pump, the magnetic valve 20 is thereby opened, thus establishing communication between the pump suction chamber and the pump work chamber. At the end of the intake stroke of the pump piston, the pump work chamber 5 is completely filled with fuel. As a result of the rotational movement of the pump piston, the communication between the intake bore 15 and the longitudinal grooves 14 is then broken. Upon the ensuing supply stroke of the pump piston the fuel in the pump work chamber 5 is compressed and pumped through the relief conduit 6 and the second transverse conduit 8 into the longitudinal distributor groove 10. During the supply stroke of the pump piston, as a result of the latter's rotation, the longitudinal distributor groove comes to coincide with one of the injection lines leading away from the cylinder 4, so that the pumped fuel can flow out via this injection line to the injection location. At first, at this time the transverse conduit 7 is still closed by the wall of the inner bore 27 of the annular slide 22. Beyond a pump supply stroke determined by the position of the annular slide 22, an opening up of the relief opening 38 subsequently takes place, so that the fuel pumped by the pump piston can now flow out via the annular groove 28, the radial bore 29 and the check valve embodied by the leaf spring into the suction chamber 16. From this instant on, the fuel supply to the injection location is prohibited in a known manner.

Now if the fuel injection pump or the internal combustion engine driven with it is to be shut off, then the intake bore 15 is closed by the magnetic valve. In that moment, the pump work chamber 5 can no longer be filled with fuel, and in this position of the pump piston a communication with the pump suction chamber via the relief conduit 6, the transverse conduit 7, the annular groove 28 and the radial bore 29 is interrupted by the closure of the outlet opening of the radial bore 29 by the leaf spring 30. Without this valve or this leaf spring 30, the fuel quantity that corresponds to the pump piston stroke up to the closure of the relief opening 38 by the control edge 40 would initially flow into the pump work chamber 5 via the relief conduit 6 during the pump piston intake stroke. During the supply stroke, this quantity can flow back out of the pump work chamber by the same route, so that actually no injection quantity could attain injection. During the remaining pump piston intake stroke after the closure of the relief opening 38, the pressure in the work chamber is dropped and the pressure level attained extends not only to the pump work chamber but also to the auxiliary chambers such as the intake bore 15 as far as the valve seat 18. These chambers, however, are disconnected from the pump work chamber during the supply stroke of the pump piston via the control edges of the longitudinal grooves 14, so that during the supply stroke there is more fuel present in the pump work chamber than is necessary to reestablish the original suction chamber level at the instant that the relief opening 38 is reopened. This excess fuel quantity then proceeds, before the relief opening 38 is opened, to injection. Since during the ensuing pump piston intake stroke the original pressure level is also reestablished in the auxiliary chambers, this injection takes place regularly, which may under some circumstances prevent a shutoff of the engine. With the valve, however, it is now assured that no more fuel can proceed to injection. The leaf spring 30 may, given the structure shown, be thin in embodiment, which increases its speed of response during opening and closing. In the closing position, the leaf spring does not have to exert any great closing force on its own, because a large pressure drop is present at the outlet cross section 29 as a result of the suction exerted by the pump piston. On the other hand, during the diversion process the leaf spring is protected by its coming to rest on the support bracket 35, if fuel at supply pressure flows out through the radial bore 29. By means of the described structure of the carrier 32, however, a leaf spring is easily replaced should it become damaged.

Figure 4:
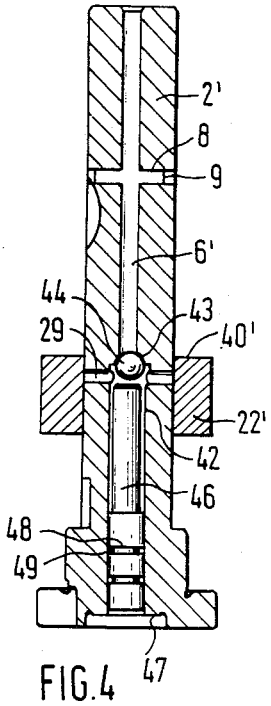
FIG. 4 shows the pump piston of a fuel injection pump according to FIG. 1, wherein the check valve is disposed in the pump piston.

In FIG. 4, a second exemplary embodiment of the invention is shown, which is realized in the pump piston. To this end, only the pump piston 2' which has been modifed from the embodiment shown in FIG. 1 is shown here, along with the correspondingly modified annular slide 22'. The annular slide 22' is displaceable on the pump piston 2' in the same manner as in the exemplary embodiment of FIG. 1, except in this case the annular slide does not have an inner annular groove 28. Serving as the control edge 40' here is the upper face end of the annular slide, by means of which edge the radial bore 29 is controlled. Deviating from the embodiment of FIG. 1, this radial bore branches off from a conduit segment 42 of the relief conduit 6', which has a larger diameter. At the transition between the relief conduit 6' and the conduit segment 42, a valve seat 43 for a ball-shaped valve closing member 44 is provided. This valve closing member 44 has a smaller diameter than the diameter of the conduit segment 42, so that after the raising of the valve closing member 44 from the valve seat 43 a sufficiently large cross section remains so as to permit the quantity flowing out of the pump work chamber to flow out through the radial bores 29 in an unthrottled manner.

The axial play for the valve closing member 44 is defined by a stop bolt 46, which is pressed into the conduit segment from the direction of the end face 47 of the pump piston that is remote from the work chamber. The conduit segment 42 is fabricated in a simple manner by drilling into the pump piston from the end face 47. For a more expensive embodiment, naturally the bolt can also be threaded into place.

The stop bolt 46 has two or more outer annular grooves 48 to secure it in the conduit segment 42, and in this embodiment deformable metal rings 49 are pressed into the outer annular grooves 48, these rings 49 being oversize, before the stop bolt 46 is pressed into place, as compared with the diameter of the conduit segment 42. By pressing the bolt into place, a tight and non-displaceable connection between the stop bolt 46 and the pump piston is attained. The metal rings 49 may for instance be realized using copper rings.

Figure 6:
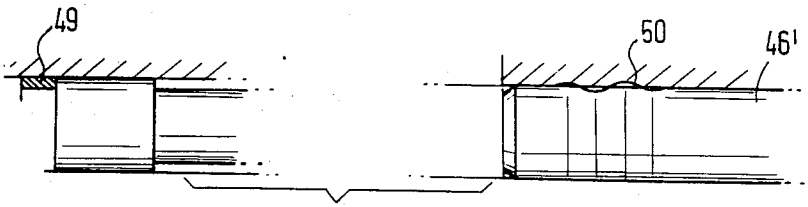
FIG. 6 shows another form of an embodiment of the securing of the stop bolt such as is used in the exemplary embodiments of FIGS. 4 or 5.
Figure 7:
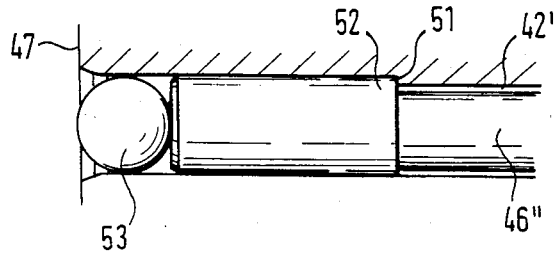
FIG. 7 shows another form of an embodiment of the fixation of the stop bolt in the pump piston.
Figure 8:
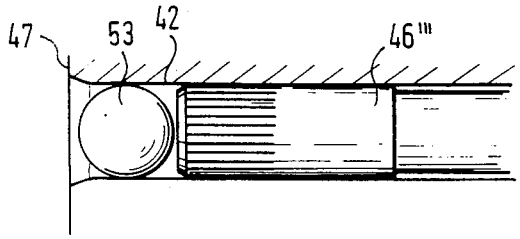
FIG. 8 shows a third variant for the fixation of a stop bolt according to the embodiment of FIG. 4.

Other ways of fastening the stop bolt 46 are shown in FIGS. 6, 7 and 8. In the exemplary embodiment of FIG. 6, annular struts 50 are produced by rolling of the end of the stop bolt. The stop bolt 46' here is made of relatively soft metallic material, so that when the bolt is pressed into place these struts are deformed to adapt to the diameter of the conduit segment 42. In the exemplary embodiment of FIG. 7, the conduit segment 42' is embodied as a stepped bore, with a shoulder 51 oriented toward the end face 47, and a corresponding shoulder 52 of the stop bolt 46'' can be brought into contact with the shoulder 51. The axial position of the stop bolt 46'' is defined in this manner. Its fixation is then accomplished by pressing a non-hardened ball 53, one having a slight oversize, into the end of the conduit segment 42'.

A further possibile fixation for a stop bolt 46'' is shown in FIG. 8, where similarly to the embodiment of FIG. 7 a ball 53 pressed into place at the outlet of the conduit segment 42 at the end face 47 is used to provide axial fixation and a tight closure of the conduit segment 42. The axial position of the stop bolt 46'' is in this case established by frictional engagement, in that the end of the stop bolt is knurled before being pressed into place and thus an oversize in comparison with the diameter of the conduit segment 42 has been attained.

The embodiment of FIG. 6 has the advantage over the embodiment of FIG. 4 that the expense of machining the stop bolt 46' is substantially less. In the exemplary embodiment of FIG. 7, a definitive position of the stop bolt 46'' is maintained, and a reliable and tight closure of the conduit segment 42 is established the inexpensive closure element, the ball 53. As compared with the embodiment of FIG. 7, the axial fixation in the embodiment of FIG. 8 is less expensive. Compared with the embodiment of FIG. 6, the end position of the stop bolt 46'' can be more easily adjusted, because here the frictional engagement of the stop bolt 46'' with the conduit segment 42 does not at the same time have to effect the tight closure of the conduit segment 42. This closure is accomplished simply and inexpensively by pressing the ball 53 into place.

Figure 5:
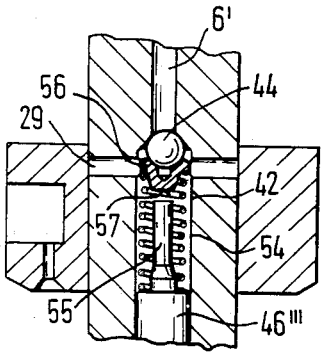
FIG. 5 shows a modification of the exemplary embodiment of FIG. 4, having a check valve provided with a restoring spring.

While in the exemplary embodiment according to FIG. 4 only a ball 44 which can move freely between the stop bolt 46 and the valve seat 43 is used as a valve closing member, the embodiment according to FIG. 5 provides a valve closing member that again has the form of a ball 44; but in this case the ball is acted upon by a restoring spring 54 supported on the stop bolt 46''''. The stop bolt 46'''' in this case has a tang 55 as its stop, which has a reduced diameter and thus makes it possible for the restoring spring 54 to be seated on the end face of the stop bolt 46''''. On the opposite end, the restoring spring 54 rests on a cup-shaped spring plate 56, in the inner bowl of which ball 44 rests and the bottom 57 of which, upon the deflection of the ball 44, can come into contact with the tang 55. The rim of the spring plate 56 slides on the inner wall of the conduit segment 42, by means of which the spring plate and the valve closing member 44 are guided. This embodiment assures a fixed position of the valve closing member and also permits a sufficiently large cross section of the conduit segment 42 that the fuel arriving from the relief conduit 6' can flow on without substantial throttling to the radial bores 29. Good centering of the valve closing member 44 and good guidance of the restoring spring 54 are furthermore assured here.

Figure 9:
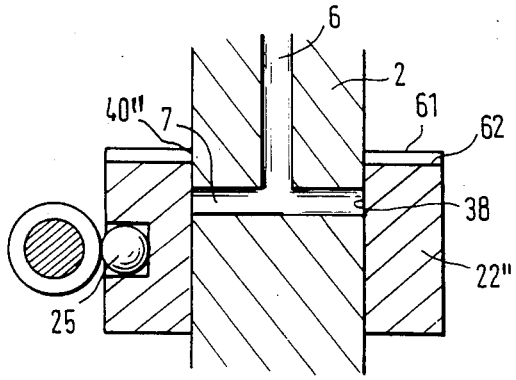
FIG. 9, is a section taken through a portion of the pump piston of a fuel injection pump according to FIG. 1 having an annular slide, the control edge of which has a meandering course.
Figure 10:
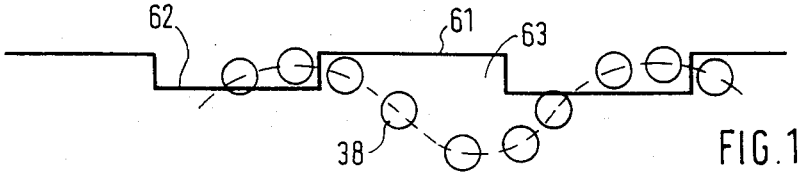
FIG. 10 shows the development of the control edge of FIG. 9 with the path of the relief bore on the pump piston.

In FIG. 9, a seventh exemplary embodiment is shown. As in the exemplary embodiment of FIG. 1, an annular slide 22'' is provided on the pump piston 2. The end face, as the control edge 40'', of the annular slide 22'' oriented toward top dead center of the pump piston controls the relief opening 38. This annular slide differs, however, in being embodied in crown-like or zig-zag fashion on this end face, such that the control edge 40'' has the form of a rectangular meander pattern, as the development of the control edge provided in FIG. 10 clearly shows. Thus with respect to the stroke control together with the pump piston movement, the control edge comprises first partial elements 61 near top dead center of the pump piston and second partial elements 62 offset parallel thereto and oriented toward bottom dead center of the pump piston. The second partial elements 62 serve to control the relief opening during the supply stroke of the pump piston, while the zig-zags 63 defined by the first partial elements 61 keep the relief opening closed after the flanks defining the zig-zags 63 laterally have been overtaken, during the intake stroke of the pump piston. In this manner, no significant fuel quantities can any longer flow out of the pump suction chamber into the pump work chamber during the intake stroke of the pump piston and disrupt the shutoff of the engine. Since in this embodiment the annular slide 22" must maintain a constant rotational position with respect to the housing, a means of guidance is required. This guidance can be easily realized, however, by means of the head 25, so that no additional expense must be borne to attain it.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a pump housing, a pump cylinder in said pump housing, a reciprocating pump piston in said pump cylinder which encloses a work chamber, a suction chamber in said pump housing, an intake bore in said pump housing and said pump cylinder through which said work chamber can be supplied with fuel from said fuel suction chamber in said pump housing during an intake stroke, a valve in said intake bore between said fuel suction chamber and said work chamber for shutting off a fuel supply from said fuel suction chamber to said work chamber, said work chamber being connected during at least a portion of a supply stroke of said pump piston with at least one fuel injection line in said pump housing that leads to an injection valve of an engine, a longitudinal conduit in said pump piston which leads exclusively from said work chamber to a radially extending relief opening located in the pump piston, said relief opening being closable by means of a quantity adjusting device that is displaceable on a portion of said pump piston which protrudes into said fuel suction chamber of said pump housing that is filled with fuel under pressure and beyond a pump piston stroke determined by an axial position of said quantity adjusting device, said relief opening being adjustable into communication via a control edge of said quantity adjusting member with said suction chamber, and a check valve closable upon a suction stroke of the pump piston is disposed on the periphery of said quantity adjusting device in a connection between said work chamber and said suction chamber.

2. A fuel injection pump as defined by claim 1, in which said check valve opens in the fuel flow direction toward the suction chamber and is disposed in the connection between the work chamber and the suction chamber.

3. A fuel injection pump as defined by claim 2, in which said quantity adjusting device has a chamber which is closable on one end by a jacket face of the pump piston and on the other by said check valve disposed on said quantity adjusting device.

4. A fuel injection pump as defined by claim 3, in which said quantity adjusting device has an outlet opening for the chamber which is closable by means of a leaf spring.

5. A fuel injection pump as defined by claim 4, in which a support member is provided in the direction of deflection of said leaf spring.

6. A fuel injection pump as defined by claim 4, in which said leaf spring is secured on a resilient carrier that is latchable in a positively engaged manner on said quantity adjusting device.

7. A fuel injection pump as defined by claim 5, in which said leaf spring is secured on a resilient carrier that is latchable in a positively engaged manner on said quantitiy adjusting device.

* * * * *